US011382819B2

(12) United States Patent
Yu et al.

(10) Patent No.: US 11,382,819 B2
(45) Date of Patent: Jul. 12, 2022

(54) WIRE-DRIVEN WRIST THREE-DEGREE-FREEDOM TRAINING MECHANISM FOR REHABILITATION OF UPPER LIMBS

(71) Applicant: UNIVERSITY OF SHANGHAI FOR SCIENCE AND TECHNOLOGY, Shanghai (CN)

(72) Inventors: Hongliu Yu, Shanghai (CN); Shengli Luo, Shanghai (CN); Suowen Ma, Shanghai (CN); Weisheng Zhang, Shanghai (CN); Qiaoling Meng, Shanghai (CN); Wentao Shi, Shanghai (CN); Bingshan Hu, Shanghai (CN); Sujiao Li, Shanghai (CN); Duojin Wang, Shanghai (CN)

(73) Assignee: UNIVERSITY OF SHANGHAI FOR SCIENCE AND TECHNOLOGY, Shanghai (CN)

( * ) Notice: Subject to any disclaimer, the term of this patent is extended or adjusted under 35 U.S.C. 154(b) by 79 days.

(21) Appl. No.: 16/968,141

(22) PCT Filed: Apr. 2, 2020

(86) PCT No.: PCT/CN2020/082874
§ 371 (c)(1),
(2) Date: Aug. 6, 2020

(87) PCT Pub. No.: WO2020/248664
PCT Pub. Date: Dec. 17, 2020

(65) Prior Publication Data

US 2022/0040026 A1 Feb. 10, 2022

(30) Foreign Application Priority Data

Jun. 10, 2019 (CN) ..... 201910497014.1

(51) Int. Cl.
*A61H 1/02* (2006.01)

(52) U.S. Cl.
CPC ..... *A61H 1/0277* (2013.01); *A61H 1/0285* (2013.01); *A61H 2201/149* (2013.01);
(Continued)

(58) Field of Classification Search
CPC ..... A61H 1/0277; A61H 1/0285; A61H 2201/149; A61H 2201/1635; A61H 2201/1673
See application file for complete search history.

(56) References Cited

U.S. PATENT DOCUMENTS 8,801,639 B2 * 8/2014 Malosio ..... A61H 1/0274 601/33
2009/0149783 A1 6/2009 Nef et al.
2015/0360069 A1 * 12/2015 Marti ..... A63B 23/03508 482/6

FOREIGN PATENT DOCUMENTS

CN 105520820 A 4/2016
CN 106109166 A 11/2016
(Continued)

OTHER PUBLICATIONS

International Search Report in PCT/CN2020/082874, issued by ISA, dated Jun. 23, 2020.
(Continued)

*Primary Examiner* — Quang D Thanh
(74) *Attorney, Agent, or Firm* — Zhu Lehnhoff LLP

(57) ABSTRACT

A wire-driven wrist three-degree-freedom training mechanism comprises a wrist executing mechanism, a wrist linking mechanism, a forearm mechanism and an elbow linking mechanism, and adopts a wire-driven design, through comprehensive utilization of two rotation pairs in the training mechanism, wherein wrist three-degree-freedom passive training is realized through two driving motors. By way of
(Continued)

the implementation of the wire-driven wrist three-degree-freedom training mechanism, a patient can adopt a passive training manner to perform rehabilitating training of the upper limbs. The wire-driven wrist three-degree-freedom training mechanism includes a position compensation mechanism and can be adapted to individual differences of patients.

10 Claims, 5 Drawing Sheets

(52) U.S. Cl.
CPC ..... *A61H 2201/1635* (2013.01); *A61H 2201/1673* (2013.01)

(56) References Cited

FOREIGN PATENT DOCUMENTS

| | | | |
|---|---|---|---|
| CN | 107095766 | A | 8/2017 |
| CN | 110179628 | A | 8/2019 |

OTHER PUBLICATIONS

Written Opinion of the International Search Report in PCT/CN2020/082874, issued by ISA, dated Jun. 23, 2020.

* cited by examiner

WIRE-DRIVEN WRIST THREE-DEGREE-FREEDOM TRAINING MECHANISM FOR REHABILITATION OF UPPER LIMBS

TECHNICAL FIELD

The invention relates to the field of upper limbs rehabilitation mechanism, in particular to the wire-driven wrist three-degree-freedom training mechanism for rehabilitation of upper limbs.

BACKGROUND

With the advancement of science and technology and the development of the times, the rehabilitation and care work for the elderly and stroke patients has gradually been replaced by more intelligent and more convenient rehabilitation robots. As the traditional upper limb rehabilitation nursing tools of the prior art, most of them focus on the upper limb shoulder and elbow rehabilitation training, but there are not many rehabilitation exercises for the wrist, mainly because the wrist has more degrees of freedom and performs relatively less obvious movements. The rotation overlap between the wrist and the training device in the passive training mode is difficult to control. Therefore, most of the wrist training mechanism design adopts active training method, but the active training method has certain limitations. For those cases where the residual muscle strength is not enough to support the patient's active training, the active training method will not help the patient in effectively restore muscle strength. At the same time, the arm rest of the traditional rehabilitation robot arm is inconvenient to adjust, and the overlap between the patient's arm center and the equipment rotation center is not enough during use, not only the training effect is poor, but the user experience is not good. In addition, each joint of the traditional rehabilitation manipulator needs to be equipped with a motor, which not only increases the burden of the rehabilitation manipulator, but also the huge volume and the radiation and noise of the motor at each joint will also cause psychological pressure to the patient.

Therefore, those skilled in the art devote themselves into developing a rope-driven wrist three-degree-freedom training mechanism for upper limb rehabilitation. The mechanism can use passive training for upper limb rehabilitation training. It has a position compensation mechanism that can adapt to the individual differences of different patients and improve the training effect and user experience of the patients. The mechanism is simple, the motor radiation and noise are low, and the patient's psychological pressure can be reduced.

SUMMARY OF THE INVENTION

In view of the above-mentioned deficiencies of the prior art, the main technical problem to be solved by the present invention is that the existing passive training upper limb rehabilitation training mechanism cannot adapt to individual differences of patients, the training effect and user experience of the patient are not good, the mechanism is complicated, and the motor radiation and the noise is high, and the psychological pressure on the patient is heavy.

To achieve the above objective, the present invention provides a wire-driven wrist three-degree-freedom training mechanism for rehabilitation of upper limbs, comprising a wrist executing mechanism, a wrist linking mechanism, a forearm mechanism, and an elbow linking mechanism; the wrist executing mechanism includes a handle, a handle supporting frame, a wrist end wire roulette, a bearing screw, an "L" shaped wrist support plate, a wrist end forward pulling wire, and a wrist end reverse pulling wire; the wrist linking mechanism includes wrist joint driven wire roulette, wrist joint outer fixation plate, wrist joint forward pulling wire, wrist joint reverse pulling wire, wrist joint inner fixation plate, wrist joint connection shaft, wrist joint auxiliary wire roulette; the forearm mechanism comprises a forearm linking rod, an arm supporting adjusting block and a arc-shaped arm rest; the elbow linking mechanism comprises an elbow joint linking block, an elbow joint forearm outer linking plate, an elbow joint upper arm outer linking plate, an elbow joint type I wire roulette, elbow joint main wire roulette, upper arm connector, elbow joint type II wire roulette, elbow joint upper arm inner linking plate, elbow joint forearm inner linking plate, elbow joint linking shaft.

The two ends of the grip handle are fixedly installed on the handle bracket, the handle bracket is fixedly installed on the lower end surface of the wrist end wire roulette, and the center axis of the wrist end wire roulette intersect perpendicularly the central axis of the grip handle, the central axis of the wrist end wire roulette coincides with the central axis of the bearing screw, the wrist end wire roulette and the bearing screw constitute a rotating pair, the free end of the "L"-shaped wrist support plate is arranged above the wrist end wire roulette, a gap is arranged between the upper end surface of the wrist end wire roulette and the free end of the "L"-shaped wrist support plate, the free end of the "L"-shaped wrist support plate is fixedly connected to the upper part of the bearing screw, and the outer circumference of the wrist end wire roulette is provided with a wrist end forward wire channel and a wrist end reverse wire channel, the fixed end of the forward pulling wire at the end of the wrist is fixedly arranged on the forward wire channel at the end of the wrist, and the fixed end of the reverse pulling wire at the end of the wrist is fixedly arranged on the reverse wire channel at the end of the wrist.

The wrist joint driven wire roulette is fixedly mounted on the wrist joint connection shaft, the wrist joint auxiliary wire roulette is movably mounted on the wrist joint connection shaft, the wrist joint auxiliary wire roulette, the wrist joint driven wire roulette coincides with the central axis of the wrist joint connection shaft, the wrist joint auxiliary wire roulette and the wrist joint connection shaft constitute a rotation pair, and the upper end of the wrist joint connection shaft is connected and the outer fixed plate of the wrist joint constitutes a rotating pair, the lower end of the wrist joint linking shaft and the inner fixed plate of the wrist joint constitute a rotating pair, the fixed end of the "L" shaped wrist support plate is fixedly mounted on the wrist joint linking shaft, The wrist joint auxiliary wire roulette is provided with a wrist joint auxiliary forward wire channel and a wrist joint auxiliary reverse wire channel on the outer circumference, and the wrist joint driven wire roulette is provided with a wrist joint forward wire channel and a wrist joint auxiliary reverse wire channel on the outer circumference, the fixed end of the wrist joint forward pulling wire is fixedly arranged on the wrist joint forward wire channel, and the fixed end of the wrist joint reverse pulling wire is fixedly arranged on the wrist joint on the wrist joint reverse wire channel, the wrist end forward pulling wire is set in the wrist joint auxiliary forward wire channel, and the wrist end reverse pulling wire is set in the wrist joint auxiliary reverse wire channel.

The inner fixed plate of the wrist joint and the outer fixed plate of the wrist joint are respectively fixedly installed on the front end of the forearm link, the lower end surface of the arm support adjustment pad is fixedly installed on the forearm linking rod, and the upper end surface of the adjusting pad is fixedly connected with the arc-shaped arm support.

The front end of the elbow joint linking block is fixedly connected to the rear end of the forearm linking rod, one end of the outer forearm linking rod of the elbow joint is fixedly connected to the outer side of the rear end of the elbow joint linking block, and one end of the inner side of the elbow joint forearm plate is fixedly connected to the inner side of the rear end of the elbow joint linking block, the elbow joint main wire roulette is arranged between the outer forearm linking plate of the elbow joint and the inner linking plate of the elbow joint forearm, and the elbow joint linking shaft passes through the other end of the elbow joint forearm inner linking plate, the elbow joint main wire roulette and the other end of the elbow joint forearm outer linking plate, the elbow joint linking shaft is fixedly connected to the elbow joint forearm inner linking plate, the central axis of the elbow joint connection shaft is colinear with the central axis of the elbow joint main wire roulette, the elbow joint connection shaft is fixedly connected to the elbow joint main wire roulette, the elbow joint linking shaft is fixedly connected to the other end of the outer forearm linking plate of the elbow joint, the outer upper arm linking plate of the elbow joint is arranged on the outer side of the outer forearm linking plate of the elbow joint, and the outer upper arm linking plate of the elbow joint and the elbow joint connection shaft constitutes a rotation pair, the inner side linking plate of the upper arm of the elbow joint is arranged on the inner side of the inner side linking plate of the forearm of the elbow joint, the inner side linking plate of the upper arm of the elbow joint and the elbow joint connection shaft constitute a rotation pair, the elbow joint type I roulette is arranged on the outer side of the upper arm of the elbow joint, the central axis of the elbow joint I roulette coincides with the central axis of the elbow joint linking shaft, the elbow joint type I wire roulette and the elbow joint connection shaft constitute a rotating pair, the elbow joint type II wire roulette is arranged on the inside of the inner linking plate of the upper arm of the elbow joint, and the central axis of the elbow joint type II wire roulette coincides to the central axis of the linking shaft of the elbow joint, the elbow joint type II wire roulette and the elbow joint connection shaft constitute a rotating pair, and the outer circumference of the elbow joint type I wire roulette is provided with a first wire channel and a second wire channel, the outer circumference of the elbow joint type II wire roulette is provided with a third wire channel and a fourth wire channel.

Further, the wrist executing mechanism comprises a copper sleeve, a fastening washer, and a lock nut, and the copper sleeve is arranged between the lower surface of the free end of the "L"-shaped wrist support plate and the upper end surface of the wrist end wire roulette, the fastening washer is arranged on upper surface of the free end of the "L"-shaped wrist support plate, the bearing screw passes through in order the copper sleeve, the free end of the "L"-shaped wrist support plate and the fastening washer to form a threaded connection with the lock nut.

Further, the wrist executing mechanism comprises a limiting pin, one end of the limiting pin is fixedly installed on the fastening washer, a limiting groove is arranged on the upper surface of the wrist end wire roulette, the limiting groove is arc-shaped, the arc of the limiting groove is not greater than 160°, and the circle center of the center wire of the limiting groove is on the rotation center wire of the wire roulette at the end of the wrist, the other end of the limiting pin passes through the free end of the "L"-shaped wrist support plate, and the other end of the limiting pin is movably arranged inside the limiting groove.

Further, the wrist executing mechanism comprises a type I wire reversing roulette, a type II wire reversing roulette, type I wire reversing roulette supporting frame, and type II wire reversing roulette supporting frame, the type I wire reversing roulette supporting frame and the type II wire reversing roulette supporting frame are fixedly arranged on the corner of the "L"-shaped wrist supporting plate, At the corner of the supporting plate, the type I wire reversing roulette supporting frame is provided with the type I wire reversing roulette, and the opening of the type II wire reversing roulette supporting frame is provided with the type II wire reversing roulette, the roulette groove of the type I wire reversing roulette is located on the tangent plane at the outlet position of the reverse wire channel at the end of the wrist, and the roulette groove of the type II wire reversing roulette is located on a tangent plane at the exit position of the forward wire channel.

Further, the thickness of the arm rest adjustment pad is adjustable, the central axis of the arc-shaped arm rest is parallel to the central axis of the bearing screw, the central axis of the arc-shaped arm rest is perpendicular to the thickness adjustment direction of the arm rest adjustment pad, and the central axis of the arc-shaped arm rest is parallel to the plane formed by the central axis of the bearing screw and the thickness adjustment direction of the arm rest adjustment pad.

Further, the forearm mechanism further comprises a forward tension pulley block, a reverse tension pulley block, a tension screw, a plug screw, the forearm linking rod is provided with a first set of waist-shaped holes and a second set of waist-shaped holes, and the length directions of the first set of waist-shaped holes and the second set of waist-shaped holes are arranged along the forearm linking rod, the depth directions of the first block of waist-shaped holes and the second block of waist-shaped holes penetrate through the upper and lower surfaces of the forearm linking rod, and the number of waist-shaped holes of the first block of waist-shaped holes is greater than or equal to 2, the number of waist-shaped holes of the second block of waist-shaped holes is greater than or equal to 2, and each of the waist-shaped hole is provided with a corresponding tension threaded through hole, and the tension threaded through holes are provided on the left and right sides of the forearm linking rod, the central axis of the tensioning threaded through hole intersects the two central axes of the corresponding waist-shaped hole perpendicularly, and the forward tensioning pulley block is fixedly installed at the first set of waist-shaped holes of the forearm linking rod through the plug screw, the reverse tension pulley set is fixedly installed at the second set of waist-shaped holes of the forearm linking rod by the plug screws, the tension screw is arranged in the tension threaded through hole, the tension screw and the tension threaded through hole form a threaded connection, and the bottom surface of the tension screw is in contact with the plug screw.

Further, the forward tension pulley set comprises a type I forward tension pulley supporting frame, a forward tension pulley, and a type II forward tension pulley supporting frame, the reverse tension pulley block includes a type I reverse tension pulley supporting frame, a reverse tension pulley, a type II reverse tension pulley supporting frame, the type I forward tension pulley supporting frame is arranged on the upper surface of the forearm linking rod, the type II forward tension pulley supporting frame is arranged on the lower surface of the forearm linking rod, the type I reverse tension pulley supporting frame is arranged on the upper surface of the forearm linking rod, and the type II reverse tension pulley supporting frame is arranged on the lower surface of the forearm linking rod, the forward tension pulley is arranged between the type I forward tension pulley supporting frame and the type II forward tension pulley supporting frame, the reverse tension pulley is arranged between the type I reverse tension pulley supporting frame and the type II reverse tension pulley supporting frame.

Further, the three-degree-freedom training mechanism for rehabilitation of upper limbs comprises a socket set screw, a crimping piece, a first drive motor, and a second drive motor, the fix ends of the forward pulling wire and the reverse pulling wire of the wrist end are fixedly installed on the wrist end wire roulette by the socket set screw and the crimping piece, and the fix ends of the forward pulling wire and the reverse pulling wire of the wrist joint are fixedly installed on the wrist joint driven wire roulette by the socket set screw and the crimping piece, the first drive motor and the second drive motor are arranged away from the wrist joint.

Further, the wire winding directions of the forward pulling wire and the reverse pulling wire of the wrist end are opposite, and the winding length of the wrist end forward pulling wire on the wrist end forward wire channel is ¾ of the circumference of the wrist end wire roulette, the winding length of the wrist end reverse pulling wire on the reverse wire channel of the wrist end is ¾ of the circumference of the wrist end wire roulette; the wrist end forward pulling wire is winded around the auxiliary forward wire channel at the wrist joint for one round after changing its direction through the type II reversing roulette, the wrist end forward pulling wire has the same direction entering and exiting the auxiliary forward wire channel at the wrist joint, the wrist end reverse pulling wire is winded around the auxiliary reverse wire channel at the wrist joint for one round after changing its direction through the type I reversing roulette, the wrist end reverse pulling wire has the same direction entering and exiting the auxiliary reverse wire channel at the wrist joint, the wire winding directions of the wrist end forward pulling wire and the wrist end reverse pulling wire of the wrist end are opposite.

The forward pulling wire at the end of the wrist wind around the reverse tension pulley and the forward tension pully in an inverted "Z" manner after leaving the wrist joint auxiliary wire roulette, the direction in which the forward pulling wire enters the reverse tension pulley is the same as the direction from which it leaves the forward tension pulley, the forward pulling wire at the end of the wrist wind around the forward tension pulley and the forward tension pully in an inverted "Z" manner after leaving the wrist joint auxiliary wire roulette, the direction in which the reverse pulling wire enters the forward tension pulley is the same as the direction from which it leaves the reverse tension pulley.

The forward pulling wire at the end of the wrist wind around the third wire channel of the elbow joint type II wire roulette after leaving the forward tension pulley, and the number of winding rounds the wrist end forward pulling wire has in the third wire channel is greater than or equal to 1, the wrist end forward pulling wire enters and exits the third wire channel in the same direction, and the wrist end reverse pulling wire wind around the first wire channel of the elbow joint type I wire roulette after leaving the reverse tension pulley, the number of winding rounds the wrist end reverse pulling wire has in the first wire channel is greater than or equal to 1, the wrist end reverse pulling wire enters and exits the first wire channel in the same direction; the free end of the forward pulling wire at the end of the wrist and the free end of the reverse pulling wire at the end of the wrist are jointly connected to the output shaft of the first driving motor.

The winding directions of the wrist joint forward pulling wire and the wrist joint reverse pulling wire in the wrist joint driven wire roulette are opposite, the winding length of the wrist end forward pulling wire on the wrist end forward wire channel is ¾ of the circumference of the wrist joint driven wire roulette, the winding length of the wrist end reverse pulling wire on the reverse wire channel of the wrist end is ¾ of the circumference of the wrist joint driven wire roulette; the forward pulling wire at the wrist joint wind around the second wire channel of the elbow joint type I wire roulette after leaving the wrist joint driven wire roulette, and the number of winding rounds the wrist joint forward pulling wire has in the second wire channel is greater than or equal to 1, the wrist end forward pulling wire enters and exits the second wire channel in the same direction; and the wrist joint reverse pulling wire wind around the fourth wire channel of the elbow joint type II wire roulette after leaving the wrist joint driven wire roulette, the number of winding rounds the wrist end reverse pulling wire has in the fourth wire channel is greater than or equal to 1, the wrist joint reverse pulling wire enters and exits the fourth wire channel in the same direction; and the free end of the wrist joint forward pulling wire and the free end of the wrist joint reverse pulling wire are jointly connected to the output shaft of the second driving motor.

The winding directions of the wrist end reverse pulling wire and the wrist end forward pulling wire at the elbow joint type I wire roulette are opposite, and the wrist end forward pulling wire and the wrist end reverse pulling wire at the elbow joint type II wire roulette are opposite.

Further, the elbow joint main wire roulette further comprises an elbow joint wire roulette inner wire channel, an elbow joint wire roulette outer wire channel, a locating hole, the elbow joint wire roulette inner wire channel, and the elbow joint wire roulette outer wire channel are arranged on the outer circumference of the elbow joint main wire roulette, and the locating holes are arranged on the end face of the elbow joint main wire roulette.

In a preferred embodiment of the present invention, the wrist forward wire and the wrist reverse wire maintain an initial position for driving the wrist end during the wrist valgus/inversion motion training, driving a forward pulling wire and a reverse pulling wire of the end of the wrist, so that the end of the wrist wire roulette rotates to drive the grip handle and then drive the wrist to complete the inversion/valgus action, and the upper limit pin arranged on the fastening pad is always kept inside the limiting groove to limit the rotation angle of the inversion/valgus action so as to prevent excessive movement of the wrist inversion/valgus action causing secondary injury to the user.

In the same preferred embodiment of the present invention, when the wrist is flexed/deflected, the wrist end forward pulling wire and the wrist end reverse pulling wire are driven to rotate the wrist end wire roulette so as to drive the grip handle to rotate, and the center wire of the grip handle is parallel with the "L" shaped wrist support plate bending section to drive the wrist joint forward pulling wire and the wrist joint reverse pulling wire, incurring the wrist joint driven roulette to drive the wrist executing mechanism to perform a reciprocating rotation to drive the wrist to complete the palmar/dorsiflexion.

In the same preferred embodiment of the present invention, when the invention is used for wrist adduction/abduction exercise training, the wrist end forward pulling wire and the wrist end reverse pulling wire are driven to drive the wrist end wire roulette to rotate grip handle, and the center axis of the grip handle is perpendicular to the bent portion of the "L" shaped wrist support plate, driving the wrist joint forward pulling wire and the wrist joint reverse pulling wire incurring the wrist joint driven roulette to drive the wrist executing mechanism to perform a reciprocating rotation to drive the wrist to complete the wrist adduction/abduction.

Compared with the prior art, the present invention has the following beneficial effects:

1. The invention breaks through the defect that the traditional rehabilitation mechanical arm is limited to active training of the wrist. Through the comprehensive application of the two rotating pairs in the training mechanism by the wire driving, the passive training of the three degrees of freedom of the wrist controlled by two motors is realized, and the wrist valgus/inversion, wrist flexion/dorsiflexion, and wrist adduction/abduction three-degree-freedom training can be realized
2. The invention overcomes the shortcomings of poor experience and poor training effects of traditional rehabilitation mechanical arms by further adjusting the spatial position of the arc-shaped arm rest, the overlap between the center of the arm and the rotation center of the device is improved, which is beneficial to user experience. It is also conducive to body functions recovery;
3. The invention overcomes the disadvantages of large volume, strong motor radiation, and loud noise of traditional rehabilitation mechanical arms. The mechanical structure is simplified through the structural design of complete wire driving, the overall volume of the training mechanism is reduced, and the drive motor far away from the joint reduces motor radiation and noise, which greatly reduces the negative impact on patients during the training process and has improved user experience.

The concept, specific structure and technical effects of the present invention will be further described in the following with reference to the accompanying drawings to fully illustrate the purpose, features and effects of the present invention.

Figure 1:
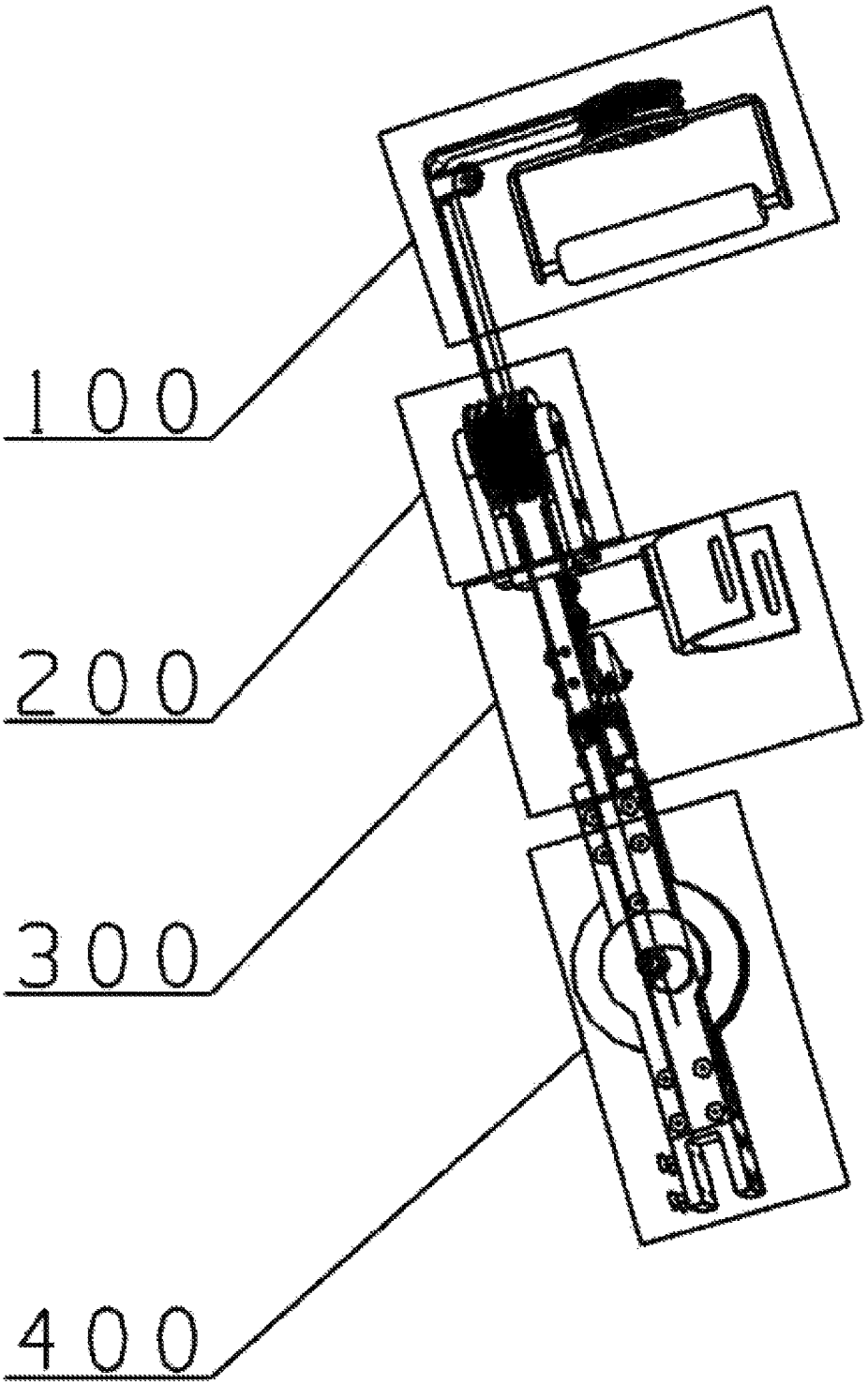
FIG. 1 is a schematic diagram of the overall module structure of a preferred embodiment of the present invention.

Among them, 100 is the wrist executing mechanism, 101 is the grip handle, 102 is the grip handle bracket, 103 is the fastening washer, 103-1 is the limit pin, 104 is the bearing screw, 105 is the lock nut, and 106 is the wrist end wire roulette, 106-1 is the arc-shaped limit slot, 107 is the type I wire reversing roulette, 108 is the type II wire reversing roulette, 109 is the "L"-shaped wrist support plate, and 110 is the type II pulling wire reversing roulette bracket, 111 is the type I wire reversing roulette bracket, 112 is the forward pulling wire at the end of the wrist, 113 is the reverse pulling wire at the end of the wrist, 114 is the copper sleeve, 200 is the wrist connection mechanism, 201 is the wrist joint driven wire roulette, 202 is the outer wrist joint fixed plate, 203 is the wrist joint forward pulling wire, 204 is the wrist joint reverse pulling wire, 205 is the wrist joint inner fixed plate, 206 is the bearing, and 207 is the wrist joint connection shaft, 208 is the wrist auxiliary wire roulette, 300 is the forearm mechanism, 301 is the forearm linking rod, 301-1 is the threaded blind hole, 301-2 is the waist-shaped hole, 301-3 is the threaded through hole, and 302 is the arm support adjustment pad, 303 is an arc-shaped arm support, 304 is a forward tension pulley block, 304-1 is a type I forward tension pulley bracket, 304-2 is a forward tension pulley, and 304-3 is a type II Forward tension pulley bracket, 305 is a reverse tension pulley block, 305-1 is a reverse tension pulley, 305-2 is a type I reverse tension pulley bracket, and 305-3 is a type II reverse tension pulley bracket, 306 is a tension screw, 307 is a plug screw, 400 is an elbow connection mechanism, 401 is an elbow joint connection block, 402 is an elbow joint forearm outer connection plate, 403 is an elbow joint upper arm outer connection plate, 404 is an elbow joint Type I wire roulette, 405 is the elbow joint main wire roulette, 405-1 is the inner wire channel of the elbow joint wire roulette, 405-2 is the outer wire of the elbow joint wire roulette, 405-3 is the locating hole, and 406 is the upper arm connector. 407 is the elbow joint type II wire roulette, 408 is the inner linking plate of the upper arm of the elbow joint, 409 is the inner linking plate of the forearm of the elbow joint, 501 is the fastening screw, and 502 is the crimping piece.

DETAILED DESCRIPTION OF THE PREFERRED EMBODIMENTS

Some of the preferred embodiments of the present invention will be introduced in the following with reference to the accompanying drawings in the specification to make the technical content clearer and easier to understand. The present invention can be embodied by many different forms of embodiments, and the protection scope of the present invention is not limited to the embodiments mentioned in the text.

In the drawings, components with the same structure are represented by the same numerals, and components with similar structures or functions are represented by similar numerals. The size and thickness of each component shown in the drawings are arbitrarily shown, and the present invention does not limit the size and thickness of each component. In order to make the illustration clearer, the thickness of the components is appropriately exaggerated in some places in the drawings.

Figure 2:
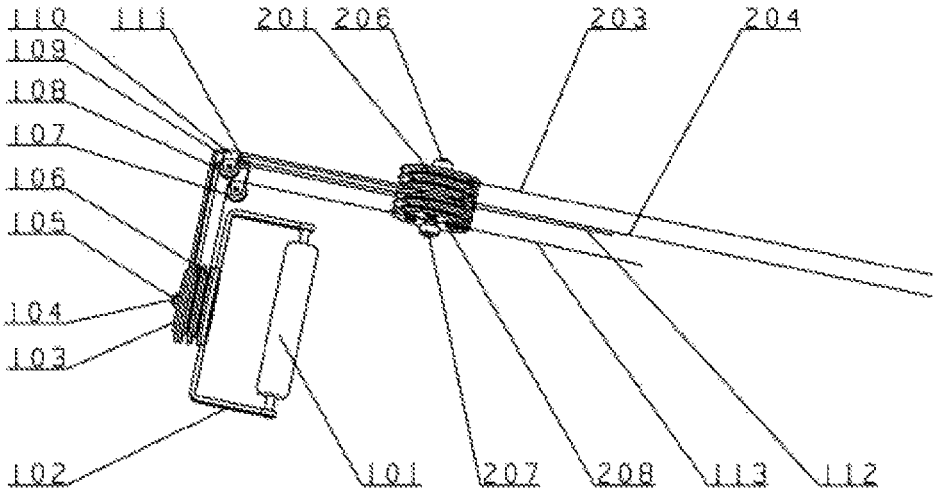
FIG. 2 is a schematic structural view of a wrist executing mechanism of a preferred embodiment of the present invention.
Figure 3:
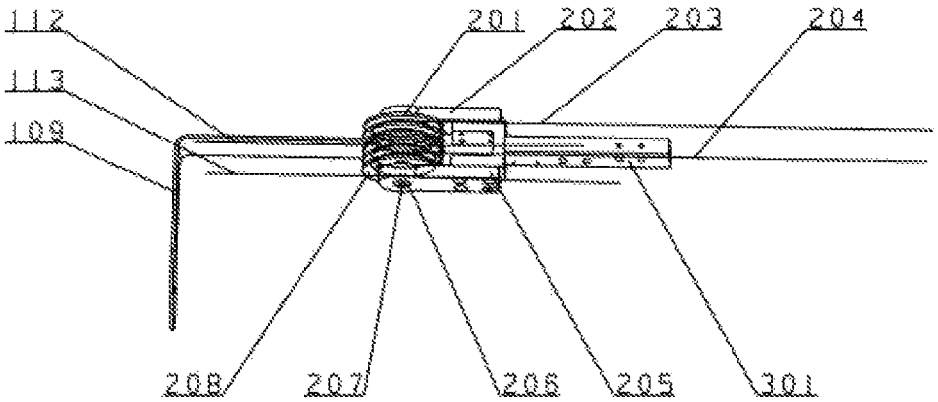
FIG. 3 is a schematic structural diagram of a wrist connection mechanism of a preferred embodiment of the present invention.
Figure 4:
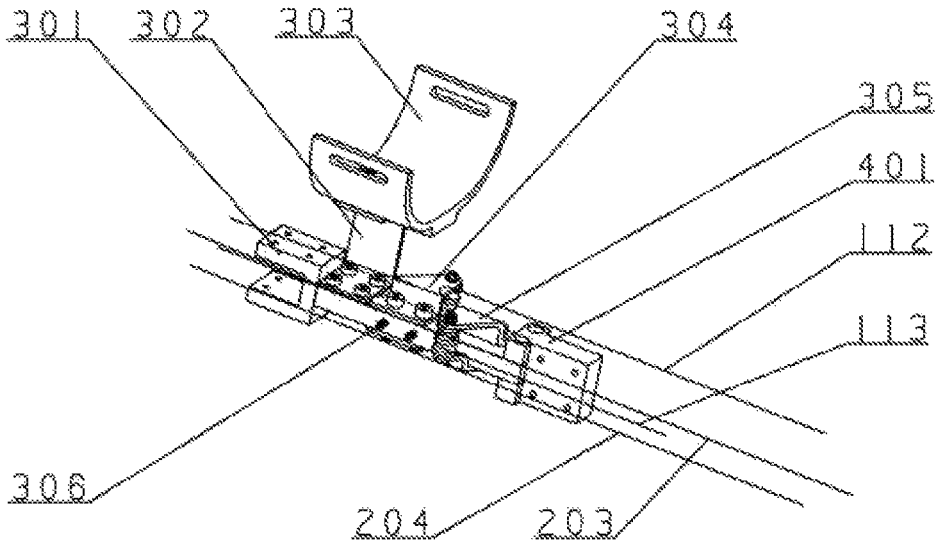
FIG. 4 is a schematic diagram of the forearm mechanism of a preferred embodiment of the present invention.
Figure 5:
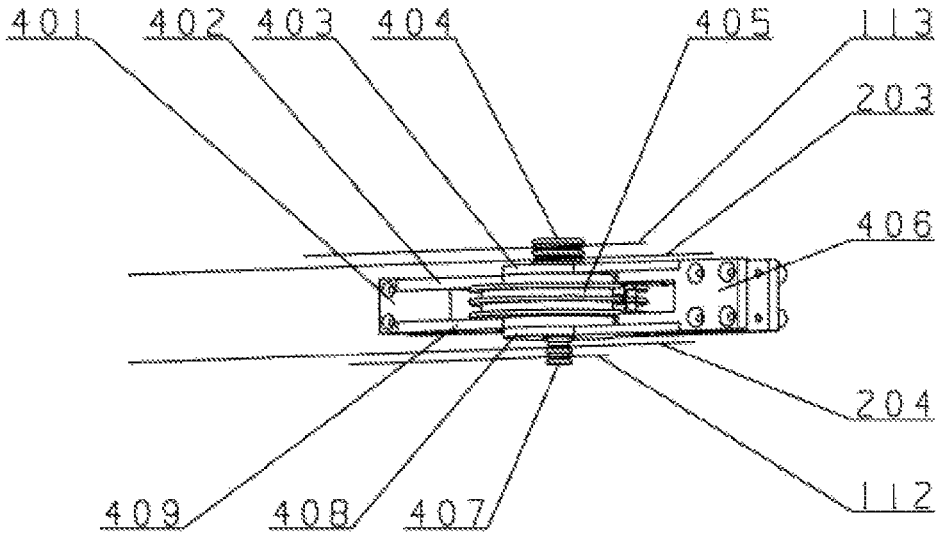
FIG. 5 is a schematic structural diagram of an elbow linking mechanism of a preferred embodiment of the present invention.
Figure 6:
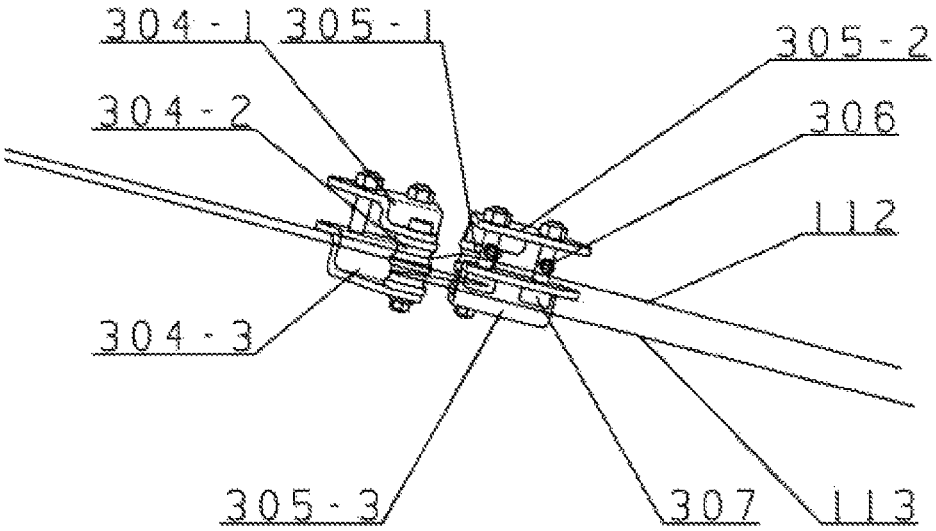
FIG. 6 is a schematic diagram of the forearm wiring structure of a preferred embodiment of the present invention.
Figure 7:
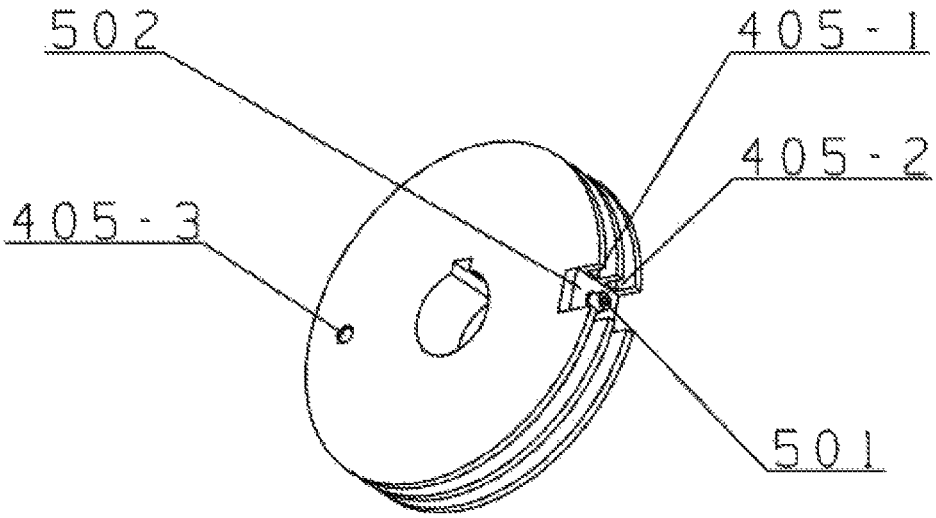
FIG. 7 is a schematic diagram of the structure of the elbow joint main wire roulette of a preferred embodiment of the present invention.
Figure 8:
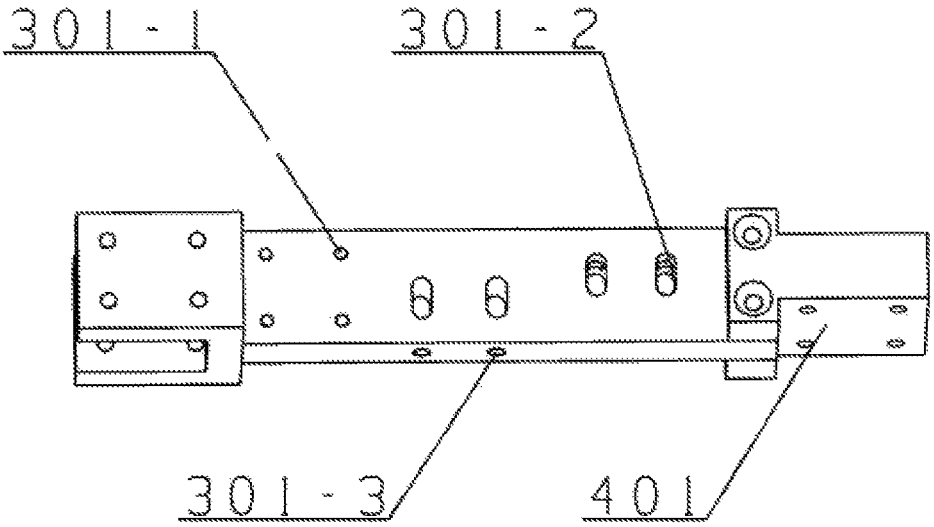
FIG. 8 is a schematic diagram of the forearm linking rod structure of a preferred embodiment of the present invention.
Figure 9:
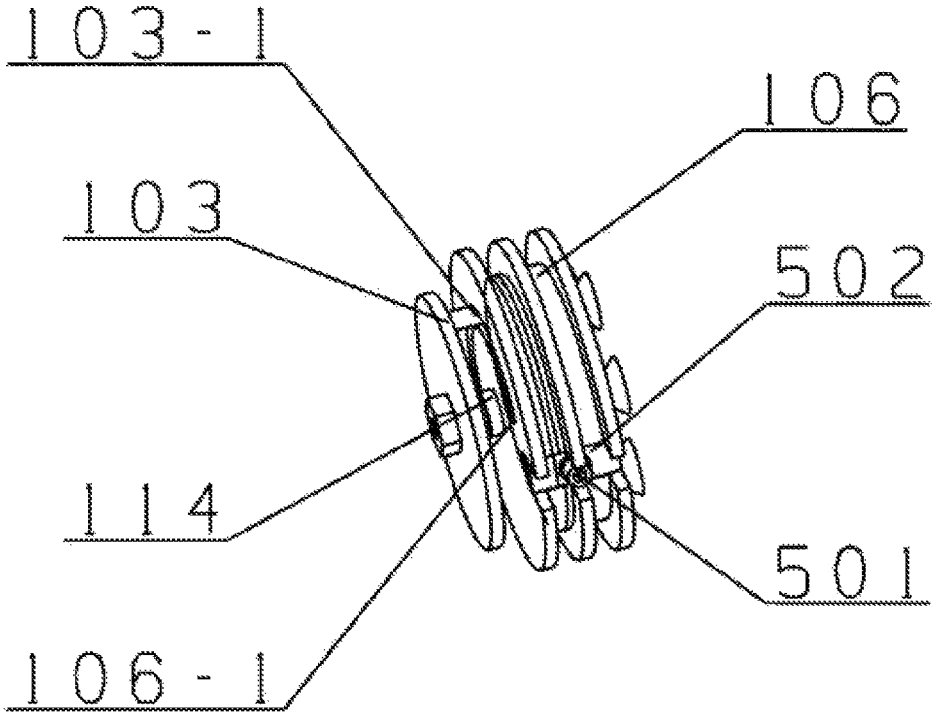
FIG. 9 is a schematic view of a wrist limiting structure of a preferred embodiment of the present invention.

In a preferred embodiment of the present invention, a wire-driven wrist three-degree-freedom training mechanism for upper limb rehabilitation includes a wrist executing mechanism 100, a wrist connection mechanism 200, a forearm mechanism 300, and an elbow connection mechanism 400. As shown in FIG. 1. The wrist executing mechanism 100 includes a grip handle 101, a grip handle bracket 102, a fastening washer 103, a bearing screw 104, a lock nut 105, a wire roulette 106 at the end of the wrist, a type I wire reversing roulette 107, and a type II wire reversing roulette 108, "L"-shaped wrist support plate 109, type II wire reversing roulette bracket 110, type I wire reversing roulette bracket 111, wrist end forward pulling wire 112, wrist end reverse pulling wire 113, as shown in FIG. 2; limit pin 103-1, arc-shaped limit slot 106-1, copper sleeve 114, as shown in FIG. 9. Wrist connection mechanism 200 includes wrist joint driven wire roulette 201, wrist joint outer fixing plate 202, wrist joint forward pulling wire 203, wrist joint reverse pulling wire 204, wrist joint inner fixing plate 205, bearing 206, wrist joint linking shaft 207 and the auxiliary wire roulette 208 of the wrist joint are shown in FIG. 3. The forearm mechanism 300 includes a forearm linking rod 301, an arm support adjustment pad 302, an arc-shaped arm support 303, a forward tension pulley block 304, a reverse tension pulley block 305, and a tension screw 306, as shown in FIG. 4; Tension pulley bracket 304-1, tension pulley 304-2, type II forward tension pulley bracket 304-3, reverse tension pulley 305-1, type I reverse tension pulley bracket 305-2, type II reverse tension pulley bracket 305-3, plug screw 307, as shown in FIG. 6; threaded blind hole 301-1, waist-shaped hole 301-2, threaded through hole 301-3, as shown in FIG. 8. The elbow linking mechanism 400 includes an elbow joint linking block 401, an elbow joint forearm outer linking plate 402, an elbow joint upper arm outer linking plate 403, an elbow joint type I roulette 404, an elbow joint main roulette 405, an upper arm linking head 406, and an elbow joint type II wire roulette 407, elbow joint upper arm inner linking plate 408, elbow joint forearm inner linking plate 409, elbow joint linking shaft (not shown in the figure), as shown in FIG. 5; elbow joint wire inner wire 405-1, elbow joint wire roulette outer wire 405-2, locating hole 405-3, set screw 501, crimping piece 502, as shown in FIG. 7. The wrist executing mechanism 100 and the wrist linking mechanism 200 are connected by a wrist joint linking shaft 207, the wrist linking mechanism 200 and the forearm mechanism 300 are connected by a forearm linking rod 301, and the forearm mechanism 300 and the elbow linking mechanism 400 are connected by an elbow joint linking block 401 Connected. The "L"-shaped wrist support plate 109 is placed between the wrist joint driven roulette 201 and the wrist joint auxiliary roulette 208 and fixedly mounted on the wrist joint linking shaft 207 by screws. The "L"-shaped wrist support plate 109 rotates with the wrist joint driven wire roulette 201, the free end of the "L"-shaped wrist support plate 109 is provided with a wrist end wire roulette 106, and is fixedly installed on the "L"-shaped wrist by a bearing screw 104 at the free end of the support plate 109, the wrist end wire roulette 106 and the bearing screw 104 constitute a rotating pair. In this embodiment, a deep groove ball bearing is preferably provided between the wrist end wire roulette 106 and the bearing screw 104, so that the wrist end wire roulette 106 and the "L"-shaped wrist support plate 109 are relatively rotatable. At the end of the bearing screw 104, it is fixedly connected by a locknut 105 equipped with a fastening washer 103, and a copper sleeve 114 is sleeved on the bearing screw 104 and is located between the "L"-shaped wrist support plate 109 and the wrist end wire roulette 106. The handle bracket 102 is fixedly connected to the lower surface of the wrist end wire roulette 106 by screws. The grip 101 is pin-connected to the handle at the end of the bracket 102, the two components are composed of a grip. The wrist end forward pulling wire 112 and the wrist end reverse pulling wire 113 are placed in two channels of the wrist end wire roulette 106 with opposite winding directions. And the winding length is ¾ of the circumference of the wrist end wire roulette 106, and the end of the wire is fixed to the wrist end roulette 106 by the crimping piece 502, which is used to ensure that the wire will not fail in the normal range of motion and prevent Excessive winding occurs and affects movement; at the openings of type I wire reversing roulette support 111 and type II wire reversing roulette support 110, there are set type I wire reversing roulette 107 and type II wire reversing roulette 108. They are respectively and fixedly connected to the corners of the "L"-shaped wrist support plate 109 by bolts, and the forward pulling wire 112 at the end of the wrist changes the routing direction through the type II wire reversing roulette 108, and the auxiliary wire around the wrist joint roulette 208 makes a round, and the direction of the wire is consistent with the direction of the wire. The reverse pulling wire 113 at the end of the wrist changes the routing direction through the type I wire reversing roulette 107, and it goes around the auxiliary wire roulette 208 of the wrist joint. Keep the wire in the same direction; both ends of the wrist joint linking shaft 207 are connected to the wrist joint outer fixing plate 202 and wrist joint inner fixing plate 205 through bearings 206, and the wrist joint inner/outer fixing plate is fixedly connected to the forearm linking rod 301 by screws, There are threaded blind holes 301-1 and two sets of waist-shaped holes 301-2 on the side of the forearm linking rod 301, and a pair of threaded through holes 301-3 are respectively provided on the upper and lower sides. The threaded through holes 301-3 correspond to the two sets of waist-shaped holes 301-2 respectively.

The arm support adjustment pad 302 is in fixed connection with the arc-shaped arm support 303 and the forearm linking rod 301 by bolts. The forward tension pulley block 304 and the reverse tension pulley block 305 arranged on the forearm linking rod 301 are symmetrical to the center, and are fixedly connected to the location of the waist-shaped hole 301-2 through the plug screw 307. The tension screw 306 works together with the threaded through hole 301-3 to fasten the plug screw 307. Elbow joint linking block 401, the front end of the elbow joint linking block 401 is fixedly connected to the rear end of the forearm linking rod 301, one end of the elbow joint forearm outer linking plate 402 is fixedly connected to the outer side of the rear end of the elbow joint linking block 401, and the inner linking plate of the elbow joint forearm inner linking plate 409 is fixedly connected to the inner side of the rear end of the elbow joint linking block 401, the elbow joint main wire roulette 405 is arranged between the elbow joint forearm outer linking plate 402 and the elbow joint forearm inner linking plate 409, and the elbow joint linking shaft passes through the other end of the elbow joint inner forearm linking plate 409, the elbow joint main wire roulette 405 and the other end of the elbow joint forearm outer linking plate 402 in order, the elbow joint connection shaft is fixedly connected to the other end of the elbow joint forearm inner linking plate 409, and the central axis of the elbow joint connection shaft is colinear with the central axis of the elbow joint main wire roulette 405, the elbow joint connection shaft is fixedly connected to the elbow joint main wire roulette 405, the elbow joint connection shaft is fixedly connected to the other end of the elbow joint forearm outer side linking plate 402, and the outer linking plate 403 of the elbow joint upper arm is arranged on the outer side of the outer linking plate 402 of the elbow joint forearm, the elbow joint upper arm outer linking plate 403 and the elbow joint linking shaft constitute a rotating pair, the elbow joint upper arm inner linking plate 408 is arranged on the inner side of the elbow joint forearm inner linking plate 409, the elbow joint upper arm inner linking plate 408 and the elbow joint linking shaft constitute a rotation pair, the elbow joint type I wire roulette 404 is arranged on the outer side the elbow joint upper arm outer linking plate 403, the center axis of the elbow joint type I wire roulette 404 coincides with the central axis of the elbow joint linking shaft, the elbow joint type I wire roulette 404 and the elbow joint linking shaft form a rotating pair, the elbow joint type II wire roulette 407 is arranged on the inside of the elbow joint upper arm inner linking plate 408, and the central axis of the elbow joint type II wire roulette 407 coincides with the central axis of the elbow joint linking shaft, the elbow joint type II wire roulette 407 and the elbow joint linking shaft form a rotating pair, and the outer circumference of the elbow joint type I wire roulette 404 is provided with a first wire channel and the second wire channel, the outer circumference of the elbow joint type II wire roulette 407 is provided with a third wire channel and a fourth wire channel, the elbow joint forearm outer linking plate 402 and the elbow joint forearm inner linking plate 409 turns after the elbow joint main wire roulette 405, As shown in FIG. 2, the groove of the type I wire reversing roulette 107 is located on the tangent plane of the wire roulette 106 at the end of the wrist to ensure that the reverse wire at the end of the wrist receives tangential force along the wire to prevent the wire from falling off due to oblique pulling; the groove of the type II wire reversing roulette 108 is located on the tangent plane at the exit position of the wire roulette 106 at the end of the wrist to ensure that the forward wire at the end of the wrist receives tangential force along the wire to prevent the wire from falling off due to oblique pulling.

As shown in FIG. 6, the forward pulling wire 112 at the end of the wrist is wound in a "Z" shape around the forward tensioning pulley block 304, and passes through the reverse tensioning pulley 305-2 and the forward tensioning pulley 304-2 in order, and the direction of entering and exiting for the wire are the same, the wrist end reverse pulling wire 113 is wound around the reverse tension pulley 305 in a "Z" shape, and then passes through the forward tension pulley 304-2 and the reverse tension pulley 305-2 in order, and the direction of entering and exiting for the wire are the same.

As shown in FIG. 7, the elbow joint main wire roulette 405 has two wire channels, namely the elbow joint wire roulette inner wire channel 405-1 and the elbow joint wire roulette outer wire channel 405-2, and the elbow joint main wire roulette 405 is provided with a set screw 501, a wire pressing piece 502, and a locating hole 405-3 at the center symmetrical position.

As shown in FIG. 8, on the side of the forearm linking rod 301, there are 4 left-right symmetrical, up-and-down symmetrical threaded blind holes 301-1 and two sets of waist-shaped holes 301-2, waist-shaped holes 301-2, a pair of threaded through holes 301-3 are respectively provided on the upper and lower sides of the forearm linking rod 301, the upper threaded through hole 301-3 corresponds to the upper side waist-shaped hole 301-2, and the lower threaded through hole 301-3 corresponds to the lower side waist-shaped hole 301-2.

As shown in FIG. 9, a tightening screw 501 and a crimping piece 502 are provided at the notch on the wrist end wire roulette 106, and a fastening washer 103 is provided parallel to the surface of the wrist end wire roulette 106. The fastening washer 103 is provided with a limiting pin 103-1, and the side of the wire roulette 106 at the end of the wrist is provided with an arc-shaped limit slot 106-1. The arc of the arc-shaped limit slot is not more than 160°, and the limit pin 103-1 is always kept in the arc-shaped limit slot 106-1.

The wire setting plan of this embodiment is as follows:

The direction of winding of the wrist end forward pulling wire 112 and the wrist end reverse pulling wire 113 in the wrist end roulette 106 is opposite, and the winding length of the forward pulling wire 112 at the end of the wrist on the forward wire channel at the wrist end is ¾ of the circumference of the wire roulette 106 of the wrist, and the winding length of the reverse pulling wire 113 at the end of the wrist on the reverse wire channel at the wrist end is ¾ of the circumference of the wire roulette 106 of the wrist; the wrist end forward pulling wire 112 is reversed through the groove of the type II wire reversing roulette 108 and then wound around the wrist joint auxiliary forward wire channel for one round. The wrist end forward pulling wire 112 enters and exits the wrist joint auxiliary forward wire channel in the same direction. The wrist end reverse pulling wire 113 is reversed through the groove of the type I wire reversing roulette 107 and then wound around the wrist joint auxiliary reverse wire for one round. The wrist end reverse pulling wire 113 enters and exits the wrist joint auxiliary reverse wire channel in the same direction. The winding directions of the wrist end forward pulling wire 112 and the wrist end reverse pulling wire 113 on the wrist joint auxiliary roulette 208 are opposite;

After the wrist end forward pulling wire 112 leaves the wrist joint auxiliary wire roulette 208, it is wound around the reverse tension pulley 305-1 and the forward tension pulley 304-2 in an inverted "Z" shape. The direction in which the wrist end forward pulling wire 112 enters the reverse tension pulley and leaves the forward tension pulley 304-2 are the same. The wrist end forward pulling wire 112 leaves the wrist joint auxiliary wire roulette 208 and then wrap around the forward tension pulley 304-2 and the reverse tension pulley 305-1 in order in an inverted "Z" shape. The direction in which the wrist end reverse pulling wire 113 enters the forward tension pulley 304-2 and leaves the reverse tension pulley 305-1 are the same;

The wrist end forward pulling wire 112 leaves the forward tension pulley 304-2 and then is wound in the third wire channel of the elbow joint type II roulette 407. The number of winding turns of the wrist end forward pulling wire 112 in the third wire channel is greater than or equal to 1, the direction of the wrist end forward pulling wire 112 enters and exits the third wire channel are the same, and the wrist end reverse pulling wire 113 leaves the reverse tension pulley 305-1 and then is wound around the first wire channel of the elbow joint type I wire roulette 404, the number of winding turns of the wrist end reverse pulling wire 113 in the first wire channel is greater than or equal to 1, the wrist end reverse pulling wire 113 enters and exits the first wire channel in the same direction; the free end of the wrist end of the forward pulling wire 112 and the free end of the reverse pulling wire 113 at the end of the wrist are jointly connected to the output shaft of the first drive motor;

The winding direction of the wrist joint forward pulling wire 203 and the wrist joint reverse pulling wire 204 in the wrist driven roulette 201 is opposite, and the winding length of the wrist joint forward pulling wire 203 on the wrist joint forward wire channel is ¾ the circumference of the wrist driven roulette 201, the winding length of the wrist reverse pulling wire 204 on the reverse wire channel of the wrist is ¾ the circumference of the wrist driven roulette 201; after the wrist joint forward pulling wire 203 leaves the wrist joint driven roulette 201, it winds around in the second wire channel of the elbow joint type I wire roulette 404, the number of winding turns of the wrist joint forward pulling wire 203 in the second wire channel equals to 1, and the wrist joint forward pulling wire 203 enters and exits the second wire channel in the same direction; the wrist joint reverse pulling wire 204 leaves the wrist joint driven roulette 201 and then winds in the fourth wire channel of the elbow joint type II wire roulette 407, the number of winding turns the wrist joint reverse pulling wire 204 in the fourth wire equals to 1, the direction of the wrist joint reverse pulling wire 204 enters and exits the fourth wire channel in the same direction, the free end of the wrist joint forward pulling wire 203 and the free end of the wrist joint reverse pulling wire 204 are both connected to the output shaft of the second drive motor;

The winding direction of the wrist end reverse pulling wire 113 and the wrist joint forward pulling wire 203 in the elbow joint type I wire roulette 404 are opposite, the winding direction of the wrist end forward pulling wire 112 and the wrist joint reverse pulling wire 204 in the elbow joint type II wire roulette 407 are opposite.

The diameter of the first wire channel and the second wire channel of the elbow joint type I roulette 404 are the same, the diameter of the third wire channel and the fourth wire channel of the elbow joint type II wire roulette 407 are the same, and the diameter of the first wire channel of the wrist joint driven roulette 201 and the wire channel of the wrist joint auxiliary wire roulette 208 are the same.

In the actual use of this embodiment, as shown in FIG. 2, when this embodiment is used for wrist flexion/dorsiflexion exercise training, the wrist end forward/reverse pulling wire is driven to make the wrist end wire roulette 106 drive the grip handle to rotate and keep the center axis of the grip handle parallel to the bending section of the "L"-shaped wrist support plate 109, and the wrist joint forward/reverse pulling wire is driven to make the wrist joint driven wire roulette 201 drive the wrist executing mechanism 100 in reciprocity to drive the wrist to complete palm flexion/dorsiflexion movements.

As shown in FIG. 9, when this embodiment is used for wrist valgus/inversion exercise training, the wrist joint forward/reverse pulling wire maintains the initial position, and the wrist end forward/reverse pulling wire is driven to make the wrist end wire roulette 106 drive the grip handle to reciprocate and then drive the wrist to complete the inversion/eversion action. The limit pin 103-1 provided on the fastening washer 103 is always kept inside the arc-shaped limit slot 106-1 to limit the angle of the inversion/eversion action to prevent excessive movement of the wrist in the valgus/valgus action.

When this embodiment is used for wrist adduction/extraction exercise training, the wrist end forward/reverse pulling wire is driven so that the wrist end wire roulette 106 drives the grip handle to rotate and the center axis of the grip handle is perpendicular to the bending section of the "L"-shaped wrist support plate 109, and the wrist joint forward/reverse pulling wire is driven to make the wrist joint driven wire roulette 201 drive the wrist executing mechanism 100 to move in reciprocity and drive the wrist to complete the adduction/abduction movement.

Although the embodiments of the invention have been shown and described, those of ordinary skill in the art shall understand that the embodiments can be subjected to various changes, modifications, replacement and variations on the premise of not deviating from the principle and the spirit of the invention. Therefore, all technical solutions that can be obtained by those skilled in the art through logical analysis, reasoning or limited experiments based on the concept of the present invention and the prior art should fall within the protection scope defined by the claims.

The invention claimed is:

1. A wire-driven wrist three-degree-freedom training mechanism for rehabilitation of upper limbs, wherein it comprises a wrist executing mechanism, a wrist linking mechanism, a forearm mechanism, and an elbow linking mechanism; wherein the wrist executing mechanism includes a grip handle, handle supporting frame, wire roulette at an end of a wrist, bearing screw, "L"-shaped wrist support plate, forward pulling wire adapted to be placed at the end of the wrist, reverse pulling wire adapted to be placed at the end of the wrist; wherein the wrist linking mechanism includes a driven wire roulette fora wrist joint, fixing plate adapted to be placed at an outer side of the wrist joint, wrist joint forward pulling wire, wrist end reverse pulling wire, fixing plate adapted to be placed at an inner side of the wrist joint, wrist joint connection shaft, wrist joint auxiliary wire roulette; wherein the forearm mechanism includes a forearm linking rod, arm support adjusting pad, arc-shaped arm support; wherein the elbow linking mechanism includes an elbow joint linking block, an outer linking plate for elbow joint forearm, an outer linking plate for an elbow joint upper arm, a type I wire roulette for elbow joint, a main wire roulette for the elbow joint, an upper arm connector, an elbow joint type II wire roulette for the elbow joint, an inner linking plate for elbow joint upper arm, an inner linking plate for elbow joint forearm, and an elbow joint linking shaft;

wherein the two ends of a grip handle are fixedly installed on the handle supporting frame, the handle supporting frame is fixedly installed on a lower end surface of a wrist end wire roulette, and a center axis of the wrist end wire roulette intersect perpendicularly with the center axis of the grip handle, a central axis of the wrist end wire roulette coincides with a central axis of a bearing screw, the wrist end wire roulette and the bearing screw constitute a rotating pair, a free end of the "L"-shaped wrist support plate is arranged above the wrist end wire roulette, a gap is arranged between a upper end surface of the wrist end wire roulette and the free end of the "L"-shaped wrist support plate, the free end of the "L"-shaped wrist support plate is fixedly connected to an upper part of the bearing screw, and an outer circumference of the wrist end wire roulette is provided with a wrist end forward wire channel and a wrist end reverse wire channel, a fixed end of the wrist end forward pulling wire is fixedly arranged on the wrist end forward wire channel, and the fixed end of the wrist end reverse pulling wire is fixedly arranged on the wrist end reverse wire channel;

wherein a wrist joint driven wire roulette is fixedly mounted on the wrist joint connection shaft, the wrist joint auxiliary wire roulette is movably mounted on the wrist joint connection shaft, the wrist joint auxiliary wire roulette, the wrist joint driven wire roulette coincides with the central axis of the wrist joint connection shaft, the wrist joint auxiliary wire roulette and the wrist joint connection shaft constitute a rotation pair, and the upper end of the wrist joint connection shaft is connected and the outer fixing plate of the wrist joint constitutes a rotating pair, the lower end of the wrist joint connection shaft and an inner fixed plate of the wrist joint constitute a rotating pair, the fixed end of the "L" shaped wrist support plate is fixedly mounted on the wrist joint connection shaft, the wrist joint auxiliary wire roulette is provided with a wrist joint auxiliary forward wire channel and a wrist joint auxiliary reverse wire channel on an outer circumference, and the wrist joint driven wire roulette is provided with a wrist joint forward wire channel and a wrist joint auxiliary reverse wire channel on the outer circumference, the fixed end of the wrist joint forward pulling wire is fixedly arranged on the wrist joint forward wire channel, and the fixed end of the wrist end reverse pulling wire is fixedly arranged on the wrist joint on the wrist joint reverse wire channel, the wrist end forward pulling wire is set in the wrist joint auxiliary forward wire channel, and the wrist end reverse pulling wire is set in the wrist joint auxiliary reverse wire channel;

wherein the inner fixed plate of the wrist joint and the outer fixing plate of the wrist joint are respectively fixedly installed on a front end of the forearm link, a lower end surface of the arm support adjusting pad is fixedly installed on the forearm linking rod, and an upper end surface of the arm support adjusting pad is fixedly connected with the arc-shaped arm support;

wherein a front end of the elbow joint linking block is fixedly connected to a rear end of the forearm linking rod, one end of the outer forearm linking plate of the elbow joint is fixedly connected to an outer side of the rear end of the elbow joint linking block, and one end of an inner side of the elbow joint forearm plate is fixedly connected to an inner side of the rear end of the elbow joint linking block, an elbow joint main wire roulette is arranged between an outer forearm linking plate of the elbow joint and an inner linking plate of the elbow joint forearm, and the elbow joint linking shaft passes through the other end of an elbow joint forearm inner linking plate, the elbow joint main wire roulette and the other end of the elbow joint forearm outer linking plate, the elbow joint linking shaft is fixedly connected to the elbow joint forearm inner linking plate, a central axis of the elbow joint linking shaft is colinear with a central axis of the elbow joint main wire roulette, the elbow joint linking shaft is fixedly connected to the elbow joint main wire roulette, the elbow joint linking shaft is fixedly connected to the other end of the outer forearm linking plate of the elbow joint, the outer upper arm linking plate of the elbow joint is arranged on an outer side of the outer forearm linking plate of the elbow joint, and the outer upper arm linking plate of the elbow joint and the elbow joint linking shaft constitutes a rotation pair, the inner linking plate of the upper arm of the elbow joint is arranged on the inner side of the inner linking plate of the forearm of the elbow joint, the inner linking plate of the upper arm of the elbow joint and the elbow joint linking shaft constitute a rotation pair, the elbow joint type I roulette is adapted to be arranged on the outer side of the upper arm of the elbow joint, a central axis of the elbow joint type I roulette coincides with a central axis of the elbow joint linking shaft, the elbow joint type I wire roulette and the elbow joint linking shaft constitute a rotating pair, the elbow joint type II wire roulette is arranged on the inside of the inner linking plate of the upper arm of the elbow joint, and the central axis of the elbow joint type II wire roulette coincides to the central axis of the linking shaft of the elbow joint, the elbow joint type II wire roulette and the elbow joint linking shaft constitute a rotating pair, and an outer circumference of the elbow joint type I wire roulette is provided with a first wire channel and a second wire channel, an outer circumference of the elbow joint type II wire roulette is provided with a third wire channel and a fourth wire channel.

2. The wire-driven wrist three-degree-freedom training mechanism for rehabilitation of upper limbs according to claim 1, wherein the wrist executing mechanism further comprises a copper sleeve, a fastening washer, and a lock nut, and the copper sleeve is arranged between a lower surface of the free end of the "L"-shaped wrist support plate and the upper end surface of the wrist end wire roulette, the fastening washer is arranged on upper surface of the free end of the "L"-shaped wrist support plate, the bearing screw passes through in order the copper sleeve, a free end of the "L"-shaped wrist support plate and the fastening washer to form a threaded connection with the lock nut.

3. The wire-driven wrist three-degree-freedom training mechanism for rehabilitation of upper limbs according to claim 2, wherein the wrist executing mechanism further comprises a limiting pin, one end of the limiting pin is fixedly installed on the fastening washer, a limiting groove is arranged on an upper end surface of the wrist end wire roulette, the limiting groove is arc-shaped, an arc of the limiting groove is not greater than 160°, and a circle center of a center wire of the limiting groove is on a rotation center wire of the wrist end wire roulette, the other end of the limiting pin passes through the free end of the "L"-shaped wrist support plate, and the other end of the limiting pin is movably arranged inside the limiting groove.

4. The wire-driven wrist three-degree-freedom training mechanism for rehabilitation of upper limbs according to claim 3, wherein the wrist executing mechanism further comprises a type I wire reversing roulette, a type II wire reversing roulette, type I wire reversing roulette supporting frame, and type II wire reversing roulette supporting frame, the type I wire reversing roulette supporting frame and the type II wire reversing roulette supporting frame are fixedly arranged on a corner of the "L"-shaped wrist supporting plate, at a corner of the supporting plate, the type I wire reversing roulette supporting frame is provided with the type I wire reversing roulette, and an opening of the type II wire reversing roulette supporting frame is provided with the type II wire reversing roulette, the roulette groove of the type I wire reversing roulette is located on a tangent plane at an outlet position of the wrist end reverse wire channel, and the roulette groove of the type II wire reversing roulette is located on a tangent plane at an exit position of the forward wire channel.

5. The wire-driven wrist three-degree-freedom training mechanism for rehabilitation of upper limbs according to claim 4, wherein a thickness of the arm support adjusting pad is adjustable, a central axis of the arc-shaped support is parallel to the central axis of the bearing screw, the central axis of the arc-shaped support is perpendicular to a thickness adjustment direction of the arm support adjusting pad, and the central axis of the arc-shaped support is parallel to a plane formed by the central axis of the bearing screw and the thickness adjustment direction of the arm support adjusting pad.

6. The wire-driven wrist three-degree-freedom training mechanism for rehabilitation of upper limbs according to claim 5, wherein the forearm mechanism further comprises a forward tension pulley block, a reverse tension pulley block, a tension screw, plug screws, the forearm linking rod is provided with a first set of waist-shaped holes and a second set of waist-shaped holes, and length directions of the first set of waist-shaped holes and the second set of waist-shaped holes are arranged along the forearm linking rod, depth directions of the first block of waist-shaped holes and the second block of waist-shaped holes penetrate through upper and lower surfaces of the forearm linking rod, and a number of waist-shaped holes of the first block of waist-shaped holes is greater than or equal to 2, a number of waist-shaped holes of the second block of waist-shaped holes is greater than or equal to 2, and each of the waist-shaped hole is provided with a corresponding tension threaded through hole, and the tension threaded through holes are provided on left and right sides of the forearm linking rod, the central axis of the tensioning threaded through hole intersects two central axes of the corresponding waist-shaped hole perpendicularly, and the forward tensioning pulley block is fixedly installed at the first set of waist-shaped holes of the forearm linking rod through the plug screws, a reverse tension pulley set is fixedly installed at the second set of waist-shaped holes of the forearm linking rod by the plug screws, the tension screw is arranged in the tension threaded through hole, the tension screw and the tension threaded through hole form a threaded connection, and a bottom surface of the tension screw is in contact with the plug screws.

7. The wire-driven wrist three-degree-freedom training mechanism for rehabilitation of upper limbs according to claim 6, wherein a forward tension pulley set comprises a type I forward tension pulley supporting frame, a forward tension pulley, and a type II forward tension pulley supporting frame, the reverse tension pulley block includes a type I reverse tension pulley supporting frame, a reverse tension pulley, a type II reverse tension pulley supporting frame, the type I forward tension pulley supporting frame is arranged on an upper surface of the forearm linking rod, the type II forward tension pulley supporting frame is arranged on a lower surface of the forearm linking rod, the type I reverse tension pulley supporting frame is arranged on the upper surface of the forearm linking rod, and the type II reverse tension pulley supporting frame is arranged on the lower surface of the forearm linking rod, the forward tension pulley is arranged between the type I forward tension pulley supporting frame and the type II forward tension pulley supporting frame, the reverse tension pulley is arranged between the type I reverse tension pulley supporting frame and the type II reverse tension pulley supporting frame.

8. The wire-driven wrist three-degree-freedom training mechanism for rehabilitation of upper limbs according to claim 7, further comprises a socket set screw, a crimping piece, a first drive motor, and a second drive motor, fix ends of the forward pulling wire and the reverse pulling wire of the wrist end are fixedly installed on the wrist end wire roulette by the socket set screw and the crimping piece, and the fix ends of the forward pulling wire and the reverse pulling wire of the wrist joint are fixedly installed on the wrist joint driven wire roulette by the socket set screw and the crimping piece, the first drive motor and the second drive motor are arranged away from the wrist joint.

9. The wire-driven wrist three-degree-freedom training mechanism for rehabilitation of upper limbs according to claim 8, wherein wire winding directions of the forward pulling wire and the reverse pulling wire of the wrist end are opposite, and a winding length of the wrist end forward pulling wire on the wrist end forward wire channel is ¾ of a circumference of the wrist end wire roulette, a winding length of the wrist end reverse pulling wire on the reverse wire channel of the wrist end is ¾ of the circumference of the wrist end wire roulette; the wrist end forward pulling wire is winded around the auxiliary forward wire channel at the wrist joint for one round after changing its direction through the type II wire reversing roulette, the wrist end forward pulling wire has the same direction entering and exiting the auxiliary forward wire channel at the wrist joint, the wrist end reverse pulling wire is winded around the auxiliary reverse wire channel at the wrist joint for one round after changing its direction through the type I wire reversing roulette, the wrist end reverse pulling wire has the same direction entering and exiting the auxiliary reverse wire channel at the wrist joint, the wire winding directions of the wrist end forward pulling wire and the wrist end reverse pulling wire of the wrist end are opposite;

the wrist end forward pulling wire wind around the reverse tension pulley and the forward tension pully in an inverted "Z" manner after leaving the wrist joint auxiliary wire roulette, a direction in which the forward pulling wire enters the reverse tension pulley is the same as a direction from which it leaves the forward tension pulley, the wrist end forward pulling wire wind around the forward tension pulley and the forward tension pully in an inverted "Z" manner after leaving the wrist joint auxiliary wire roulette, a direction in which the reverse pulling wire enters the forward tension pulley is the same as a direction from which it leaves the reverse tension pulley;

the wrist end forward pulling wire wind around the third wire channel of the elbow joint type II wire roulette after leaving the forward tension pulley, and the number of winding rounds the wrist end forward pulling wire has in the third wire channel is greater than or equal to 1, the wrist end forward pulling wire enters and exits the third wire channel in the same direction, and the wrist end reverse pulling wire wind around the first wire channel of the elbow joint type I wire roulette after leaving the reverse tension pulley, the number of winding rounds the wrist end reverse pulling wire has in the first wire channel is greater than or equal to 1, the wrist end reverse pulling wire enters and exits the first wire channel in the same direction; a free end of the wrist end forward pulling wire and a free end of the wrist end reverse pulling wire are jointly connected to a output shaft of the first drive motor;

the winding directions of the wrist joint forward pulling wire and the wrist end reverse pulling wire in the wrist joint driven wire roulette are opposite, the winding length of the wrist end forward pulling wire on the wrist end forward wire channel is ¾ of the circumference of the wrist joint driven wire roulette, the winding length of the wrist end reverse pulling wire on the reverse wire channel of the wrist end is ¾ of the circumference of the wrist joint driven wire roulette; the forward pulling wire at the wrist joint wind around the second wire channel of the elbow joint type I wire roulette after leaving the wrist joint driven wire roulette, and the number of winding rounds the wrist joint forward pulling wire has in the second wire channel is greater than or equal to 1, the wrist end forward pulling wire enters and exits the second wire channel in the same direction; and the wrist end reverse pulling wire wind around the fourth wire channel of the elbow joint type II wire roulette after leaving the wrist joint driven wire roulette, the number of winding rounds the wrist end reverse pulling wire has in the fourth wire channel is greater than or equal to 1, the wrist end reverse pulling wire enters and exits the fourth wire channel in the same direction; and the free end of the wrist joint forward pulling wire and the free end of the wrist end reverse pulling wire are jointly connected to a output shaft of the second drive motor;

the winding directions of the wrist end reverse pulling wire and the wrist end forward pulling wire at the elbow joint type I wire roulette are opposite, and the wrist end forward pulling wire and the wrist end reverse pulling wire at the elbow joint type II wire roulette are opposite.

10. The wire-driven wrist three-degree-freedom training mechanism for rehabilitation of upper limbs according to claim 9, wherein the elbow joint main wire roulette further comprises an elbow joint wire roulette inner wire channel, an elbow joint wire roulette outer wire channel, a locating hole, the elbow joint wire roulette inner wire channel, and the elbow joint wire roulette outer wire channel are arranged on a outer circumference of the elbow joint main wire roulette, and the locating holes are arranged on an end face of the elbow joint main wire roulette.

* * * * *